US011846157B2

(12) United States Patent
Bucciarelli et al.

(10) Patent No.: US 11,846,157 B2
(45) Date of Patent: Dec. 19, 2023

(54) SAFETY VALVE FOR A FLUID EXTRACTION WELL INSTALLATION

(71) Applicant: Motomecanica Argentina S.A., Buenos Aires (AR)

(72) Inventors: Adrian Oscar Bucciarelli, Buenos Aires (AR); Mario Ariel Vanzino, Buenos Aires (AR)

(73) Assignee: Batfer Investment S.A., Montevideo (UY)

( * ) Notice: Subject to any disclaimer, the term of this patent is extended or adjusted under 35 U.S.C. 154(b) by 0 days.

(21) Appl. No.: 17/964,599

(22) Filed: Oct. 12, 2022

(65) Prior Publication Data

US 2023/0296000 A1 Sep. 21, 2023

(30) Foreign Application Priority Data

Mar. 18, 2022 (AR) ..... M20220100639

(51) Int. Cl.
*E21B 34/10* (2006.01)
*E21B 33/06* (2006.01)

(52) U.S. Cl.
CPC ..... *E21B 34/102* (2013.01); *E21B 33/06* (2013.01); *E21B 2200/05* (2020.05)

(58) Field of Classification Search
CPC ..... E21B 34/102; E21B 2200/05; E21B 33/06
USPC ..... 137/527.8; 251/304, 314, 359
See application file for complete search history.

(56) References Cited

U.S. PATENT DOCUMENTS 6,079,497 A * 6/2000 Johnston ..... E21B 34/101 166/324
6,296,061 B1 * 10/2001 Leismer ..... E21B 34/101 166/324
7,246,668 B2 * 7/2007 Smith ..... E21B 34/10 166/332.8
7,624,809 B2 * 12/2009 Frazier ..... E21B 43/14 166/332.8
8,651,188 B2 * 2/2014 Scarsdale ..... E21B 43/123 137/516.29
9,745,822 B2 * 8/2017 Bernard ..... E21B 34/06
11,613,957 B1 * 3/2023 Zahur ..... E21B 33/127 166/305.1
2007/0137869 A1 6/2007 MacDougall et al.
(Continued)

FOREIGN PATENT DOCUMENTS

AR 085237 1/2013

*Primary Examiner* — Daphne M Barry
(74) *Attorney, Agent, or Firm* — Bushman Werner, P.C.

(57) ABSTRACT

The invention refers to a safety valve having a double seal system that combines a metal-metal seal and an elastomeric ring arranged on the valve body. The safety valve comprises and external casing having a hollow main body configured to receive a piston that slides axially between an upper position and a lower position, the safety valve comprises a closing element pivotally attached to an annular seat and actuated by a torsion spring, wherein said closing element has a support face on the annular seat comprising a recessed perimeter surface and sloping intermediate surface jointly forming a first seal region, said annular seat has a second seal region consisting with said first seal region on the closing element, both regions defining a metal-metal seal, and wherein said second seal region on the annular seat comprises a perimeter groove configured to house a seal element made from elastomer.

10 Claims, 5 Drawing Sheets

(56) References Cited

U.S. PATENT DOCUMENTS

| | | | | |
|---|---|---|---|---|
| 2012/0012202 | A1* | 1/2012 | Smith | E21B 34/10<br>137/527 |
| 2023/0116558 | A1* | 4/2023 | AlSultan | E21B 47/07<br>166/250.01 |

* cited by examiner

SAFETY VALVE FOR A FLUID EXTRACTION WELL INSTALLATION

CROSS-REFERENCE TO RELATED APPLICATION

This application claims priority to Argentine Application No. M20220100639 filed on Mar. 18, 2022, the disclosure of which is incorporated herein by reference for all purposes.

OBJECT OF THE INVENTION

The present invention refers to a safety valve that allows an intervention to be safely performed in a fluid extraction well installation, particularly in an oil extraction multi-pad well installation, without the need to close nearby wells.

BACKGROUND OF THE INVENTION

A multipad well installation is a location where there is more than one well spaced from one another at a distance of approximately 32.80 ft (10 m). When performing an intervention in one of the wells, it is necessary to close the nearby wells as a precaution measure, since if by for some reason, part of the structure used to perform the intervention falls on one of the adjacent wells, this may give rise to the breakage of the Christmas tree, causing a blowout of production.

To avoid the risk of uncontrolled oil spills during the intervention of a well in a multipad well installation, the invention provides a safety valve actuated by overflow.

More particularly, the present invention provides a clapper or flapper safety valve that requires the use of a hydraulic lubricator (B) for the installation thereof. The valve is installed in the housing intended for the BPV (Back Pressure Valve) of the pipe or casing hangers (C).

The valve of the present invention was designed to be operated with the normal production flow of a well; as long as the production flow does not change, said valve remains open. In the event of an increase in said flow due to any circumstance, the valve will close immediately.

It has a clapper or flapper that closes at the time of overflow. This clapper or flapper has a primary metal-to-metal seal and a secondary low pressure elastomeric seal. The valve is normally in open position due to the action of a main spring which is responsible for keeping the valve open, allowing the stroke of a piston through the annular body of the clapper or flapper safety valve. Said spring is designed to provide the necessary force to withstand the back pressure forces produced by the normal production flow.

During an event in which control of the Christmas tree is lost, a pressure difference is generated, where well pressure is provided on one side of the safety valve, while atmospheric pressure is exerted on the opposite side thereof. Said pressure differential compresses the main spring allowing the clapper or flapper to close on the valve body due to the action of a torsion spring acting on said clapper or flapper to bring it to said closed position maintained by the action of the well overpressure. To further ensure the closing of the safety valve, the present invention provides a double seal system that combines a metal-metal seal and an elastomeric ring arranged on the valve body, which has the functional advantage of minimizing the chances of fluid leaks due to a faulty closing of the clapper on the safety valve body.

The normal production flow increase and, thus, a pressure increase, can be caused if the Christmas tree controlling said flow is accidentally damaged.

Clapper or flapper safety valves are known in the prior art as disclosed in document US2007137869 (A1) from Schlumberger Technology corp. This patent discloses a system for actuating a valve closing member within an underground safety valve with a tubular body (external casing) adapted for the installation thereof within a well, which defines a fluid path.

The valve closing member (clapper) is pivotally located on the tubular body (casing) by means of a hinge for the movement thereof through a closure path between the open and close positions of the fluid path; the safety valve has, moreover, a first actuator (clapper spring) which pushes the closing member of the valve (clapper) to the closed position thereof, and an axial flow pipe (sliding tubular element) which is movable within the tubular body (casing) between a first position that prevents the first actuator (clapper spring) from pushing the valve closing member (clapper) to the closed position thereof and a second position that allows the first actuator to push the valve closing member (clapper) to the closed position thereof. The safety valve also uses a second actuator, in the form of a thrust means such as a helical spring, to push the flow pipe (sliding tubular element) towards the second (upper) position thereof, said second actuator being arranged above the clapper. In addition, the device comprises an actuation system: a latch assembly which prevents the movement of the valve closing member (clapper) from the open position to the closed position thereof until the flow pipe has been pushed out of the closing path.

The description of this document discloses that the clapper valve is pivotally connected to the tubular body by means of a pivot pin, and cooperates with an annular valve seat placed around the fluid path causing the closing of the safety valve. Therefore, when the clapper is in top position and seated on the valve seat (see FIG. 2D), the safety valve is closed blocking the upstream flow through the conduit and the well tubing.

However, this document does not disclose the combined use of a mechanical seal (metal-metal) and an elastomeric-type backup seal as proposed by the present invention to minimize the chances of fluid leaks during a well overpressure event.

Document AR085237 (A1) discloses a flapper-type check valve including a valve body, a valve cap pivotally coupled to the valve body at a hinge between an open position and a closed position, and a directing element (spring) that directs the valve cap to the closed position. FIG. 2*a* shows a flapper valve 200 in closed position according to various embodiments. A tubular member houses a flapper valve body and is fitted above the bit in the drillstring. The flapper valve body is coupled to a flapper valve cap with the rotary coupling. In some embodiments, the rotary coupling comprises a hinge. A thrust element applies a spring force to push the flapper valve cap into a closed position. In the closed position, the flapper valve prevents fluids from flowing through the valve. The flapper valve cap includes a lip that rests against the valve body 204 when the flapper valve is in closed position.

The valve cap also includes a seal surface for the sealing thereof against the valve body when the valve cap is in closed position.

However, this document does not disclose the combined use of a (metal-metal) mechanical seal and an elastomeric-type backup seal as proposed by the present invention, the functional advantage of which lies in minimizing the chances of fluid leaks during an overpressure condition in the well.

DETAILED DESCRIPTION OF THE INVENTION

The invention will now be described with reference to FIGS. 1-4, which show a preferred embodiment of the invention.

The present invention provides a safety valve that allows the safe intervention of a well installation for the extraction of fluids, particularly, a multipad well installation for the extraction of oil (FIG. 1), without the need for shutting down nearby wells, and minimizing the chances of fluid leaks during the intervention.

An important additional advantage of the safety valve of the present invention is the adaptability thereof, since each well of a fluid extraction well installation has different operating characteristics, that is, different production pressures, well pressures, production flow rates, (liquid or gas) fluid compositions, among others; that is why the safety valve of the present invention has been designed to adapt to all these conditions by changing the main actuator (spring) and the dimensions of the calibrated port. Thus, the safety valve of the present invention may be configured to be installed in any type of well.

Figure 4A:
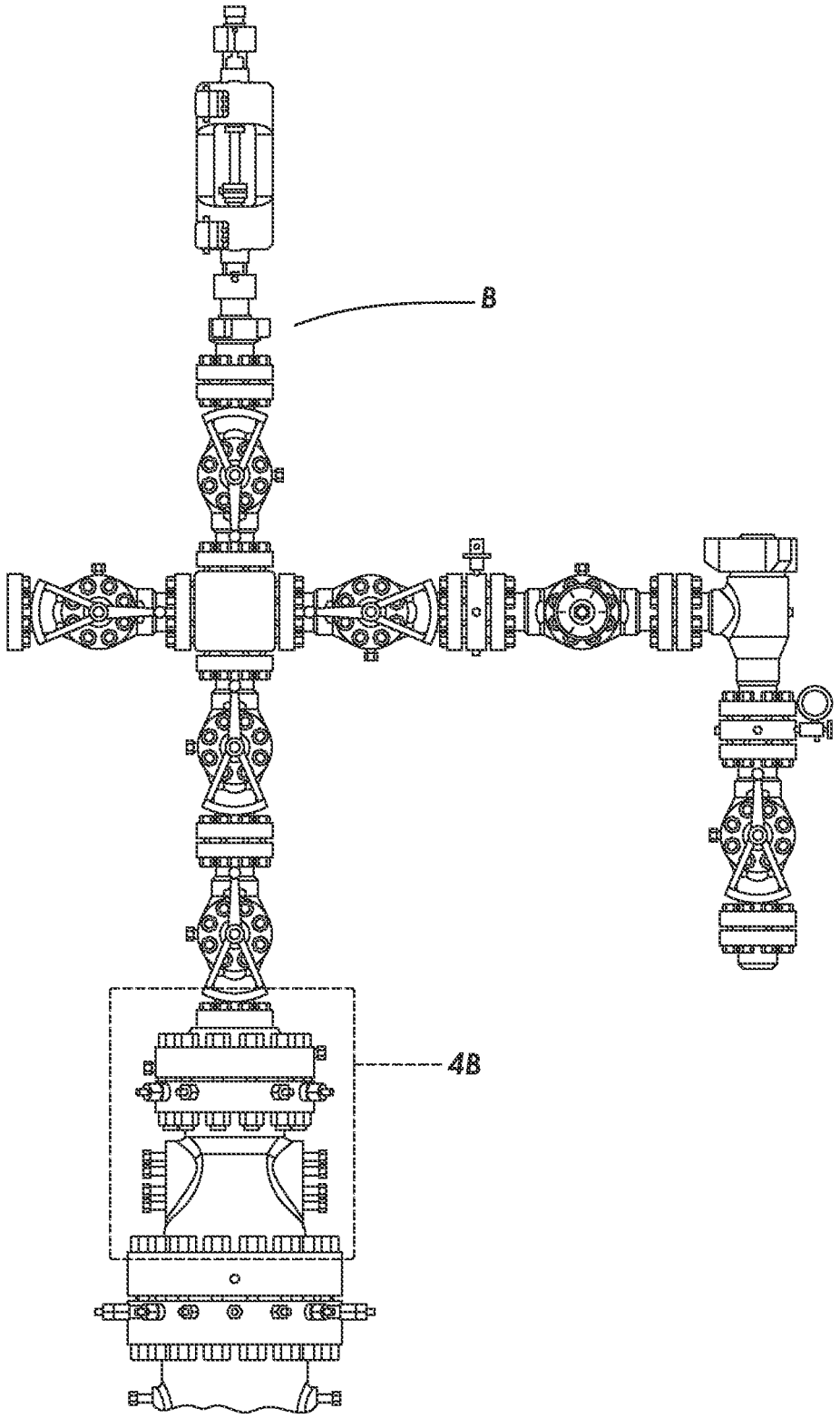
FIG. 4 shows a detailed view of an oil wellhead lubricating device B where the position of the safety valve A of the present invention can be seen in the housing intended for the BPV (Back Pressure Valve) of the pipe hangers (C) (FIG. 4A) and a cross-sectional view of the safety valve A (FIG. 4B).
Figure 4B:
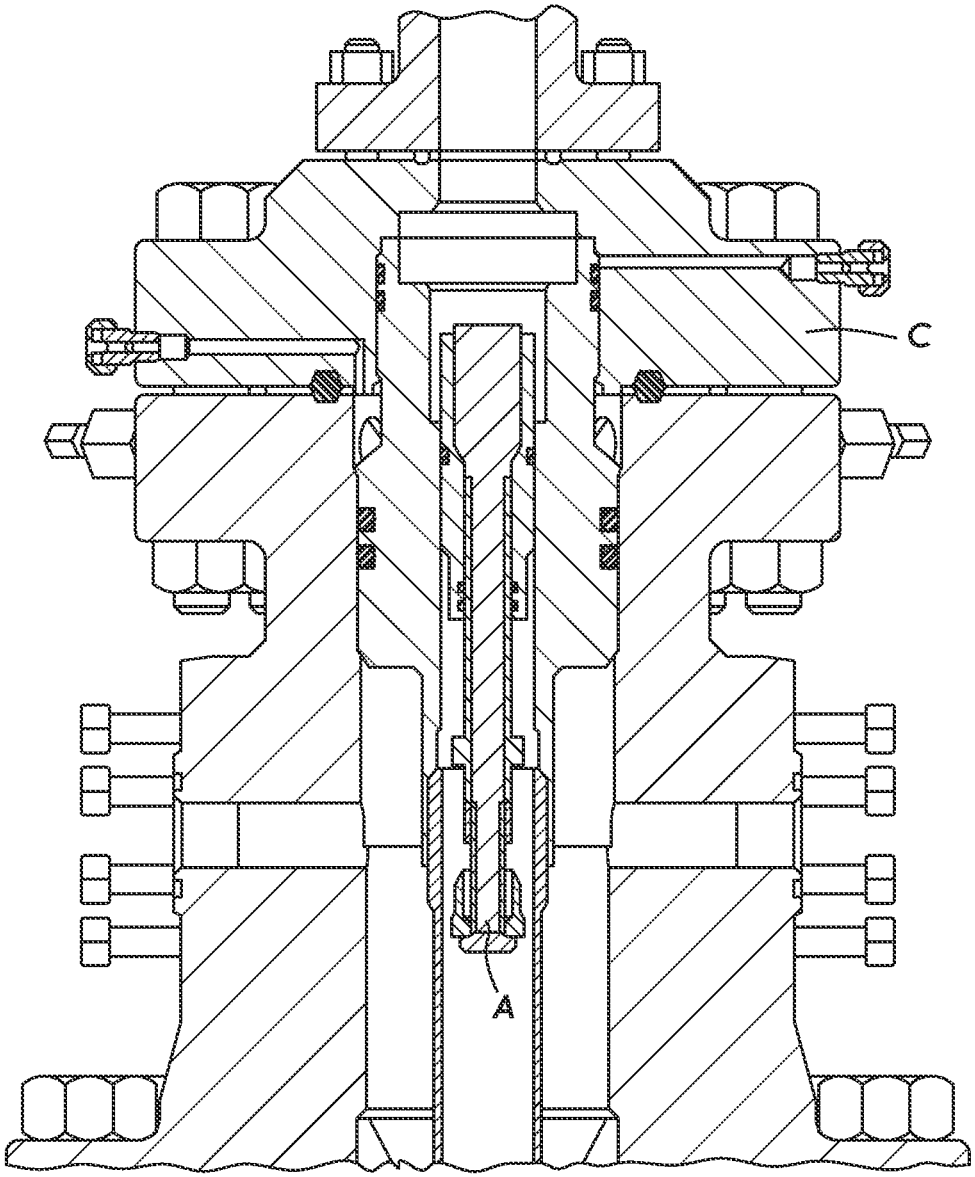

The present invention provides a particularly useful safety valve to be installed in the BPV (Back Pressure Valve) housing of tubing or casing hangers (FIG. 4). More particularly, the present invention provides a safety valve that requires the use of a hydraulic lubricator (B) for the installation thereof.

The valve of the present invention was designed to be operated with the normal production flow of a well; as long as the production flow does not change, said valve remains in open position due to a first actuator or main spring that allows the passage of a tubular element which slides through the annular body of the safety valve keeping the clapper or flapper in open position. In the event of a flow rate increase, the valve will close immediately moving the sliding tubular element upwards, compressing the first actuator so that the clapper or flapper closes onto the valve seat due to the force produced by a second actuator or torsion spring (FIG. 2).

Figure 1:
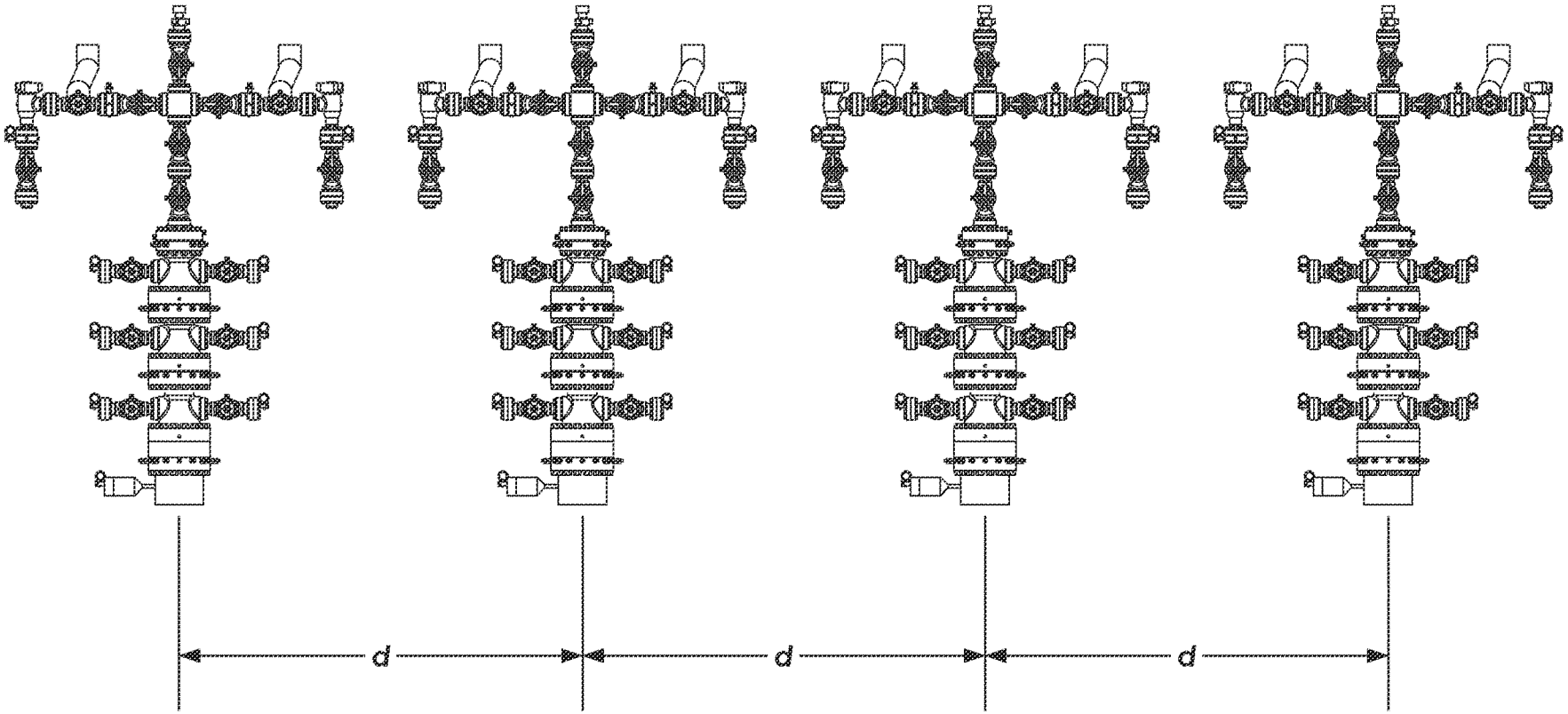
FIG. 1 shows an example of a multipad oil well installation.
Figure 2A:
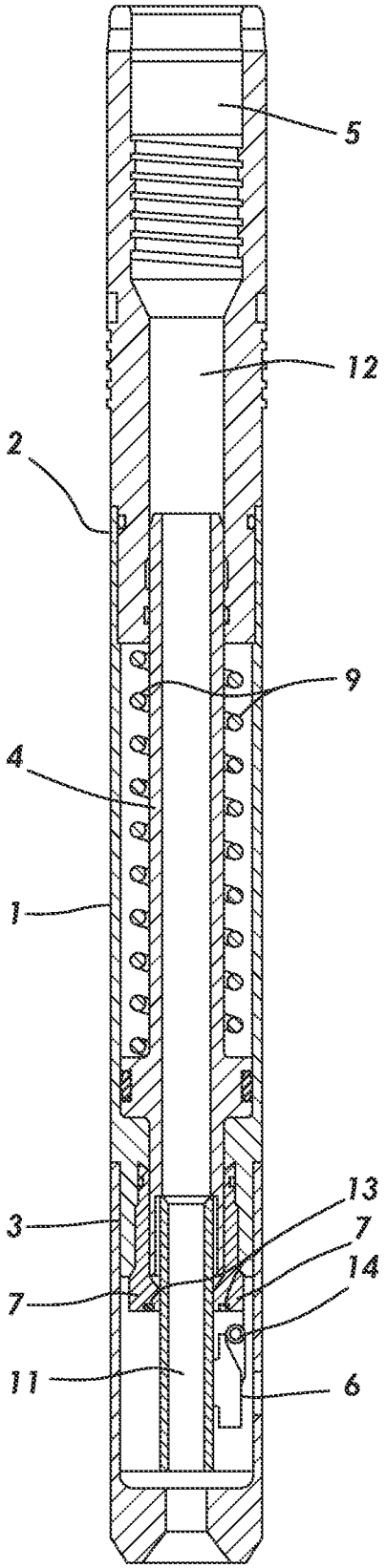
FIG. 2 shows a cross-sectional view of the components of the safety valve of the present invention in open position (FIG. 2A) and in closed position (FIG. 2B).
Figure 2B:
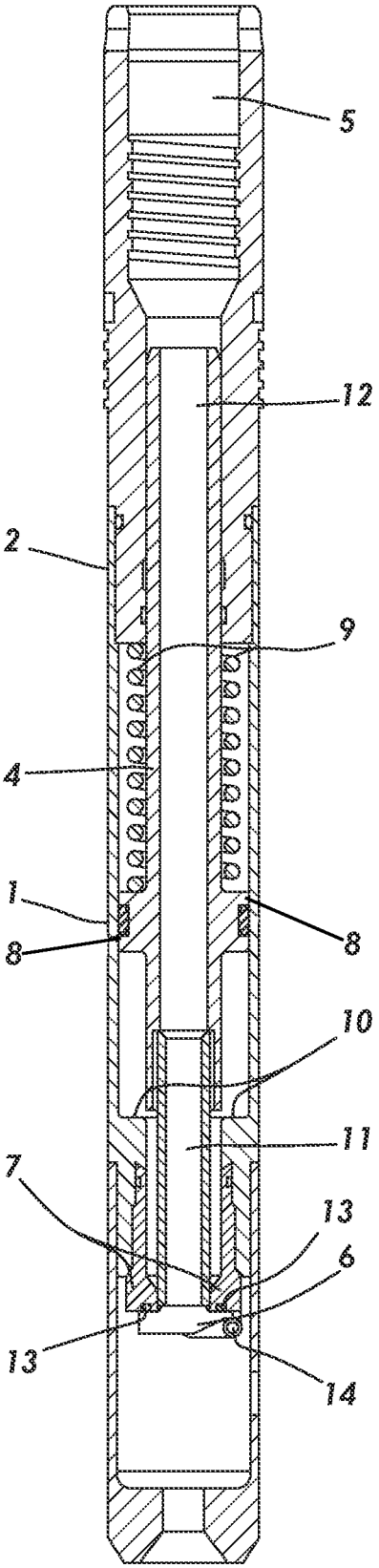
Figure 3A:
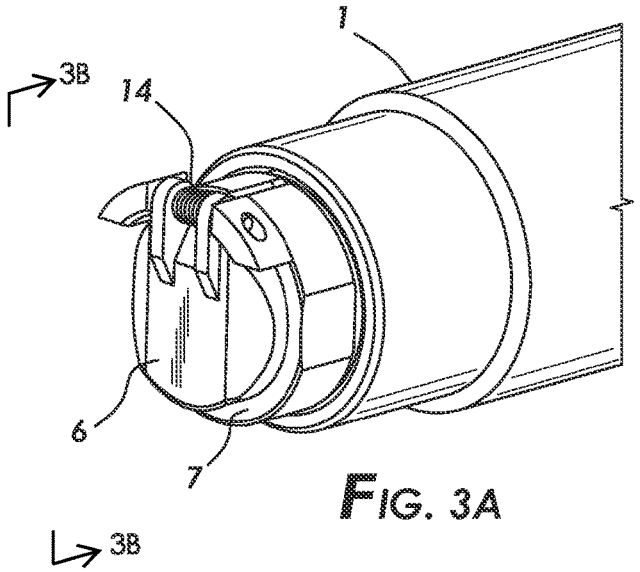
FIG. 3 shows a detailed view of FIG. 2, the clapper closed onto the annular clapper seat thereof (FIG. 3A), a cross-sectional view thereof (FIG. 3B) and a detailed view of the metal-metal seal and the elastomeric seal (FIG. 3C).

The present safety valve A comprises an external casing 1 with a hollow main body, an upper end 2 and a lower end 3, and said hollow main body of said external casing 1 is configured to receive a piston 12 with an end 4 sliding axially between an upper position and a lower position (FIG. 2). On the upper end 2 of said external casing 1, there is an upper connection element 5 with an interface for the installation and removal of safety valve A, while on the lower end 3 of said external casing 1, there is a closing element 6 (clapper or flapper) pivotally attached, for example, by means of a hinged joint, to an annular seat 7 of the closing element 6 that connects with the external casing 1 at the lower end 3 thereof (FIG. 3).

The inner wall of said external casing 1 has, in the lower portion thereof, a ledge 10 defining a calibrated passage 11, so that said ledge 10 may act as a lower stop for the stroke of said piston 12 with one end of piston 4 moving in the direction of the axial shaft inside the hollow outer casing 1.

Piston end 4 comprises a shoulder 8 in the lower portion thereof. Together with the inner wall of the external casing 1 and the upper connection element 5, said shoulder 8 defines an annular space configured to house a first main actuator or spring 9. In the expanded position thereof, under normal well pressure, said first main actuator 9 forces the sliding element 4 to move downwards so that shoulder 8 of said piston end 4 abuts on the ledge 10 of the inner wall of the outer casing 1.

Calibrated passage 11 allows the controlled passage of piston 12 that passes through the annular seat body 7 of the clapper on the downward path thereof under normal operating pressure.

Closing element 6, which is configured as a clapper or flapper, is articulated to the annular seat 7 by means of a pivotable joint actuated by a second actuator or torsion spring 14. Preferably, the pivotable joint is a hinge in whose rotation axis said second actuator 14 is inserted (FIG. 3*a*). Preferably, the annular seat body 7 of the closing element 6 is connected to the lower end of the casing 1 by means of a threaded joint.

Figure 3B:
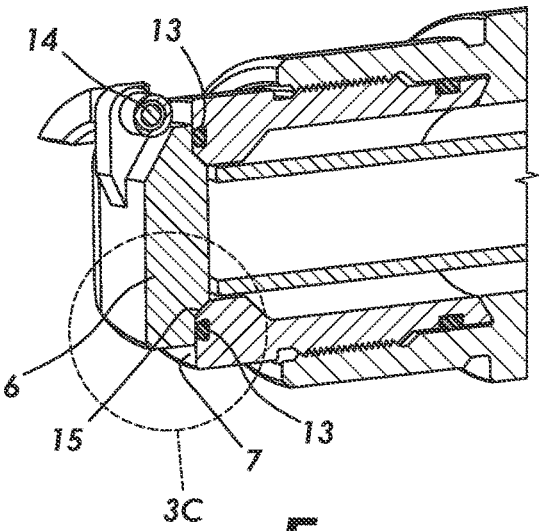
Figure 3C:
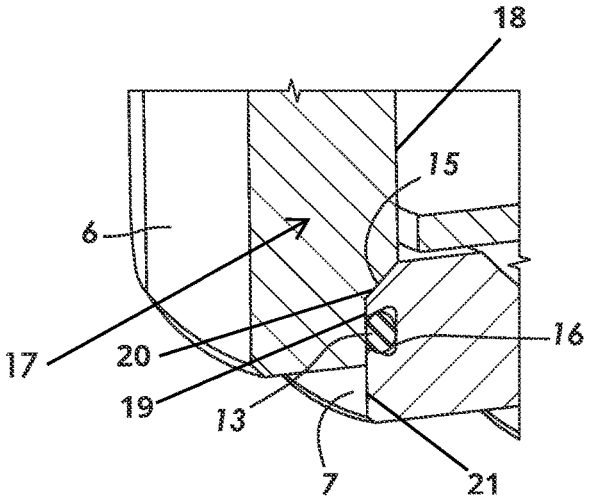

Closing element 6 has a support face 17 on the annular seat 7 (FIG. 3*b*). Said support face 17 has a central surface 18 projected in axial direction and a recessed perimeter surface 19, where the central surface 18 and the recessed perimeter surface 19 join without interruption through a sloping intermediate surface 20, said central surface 18 and said sloping intermediate surface 20 defining a frustoconical cross-section. The intermediate surface 20 and the recessed perimeter surface 19 jointly form a first seal region with the annular seat 7 of the clapper, which consequently has a second seal region consistent with said first seal surface, thus defining a metal-to-metal seal 15 (FIG. 3*b*).

Additionally, on the outer perimeter edge 21 of the second seal region of the annular seat 7, there is a perimeter groove 16 configured to house a seal element 13 that provides a backup seal under low pressures and that jointly acts with the metal-to-metal seal 15 to achieve a airtight closure of the closing element or clapper 6 on the annular seat 7 thereof. Preferably, the seal element 13 is of elastomeric type and is composed of highly abrasion-resistant elastomers, such as nitrile butaidene rubber (NBR), ethylene propylene diene elastomer (EPDM), hexafluoropropylene thermopolymer, with vinylidene fluoride, tetrafluoroethylene and perfluoromethyl vinyl ether (FPM), elastomeric polyurethane, elastomeric silicone (VMQ, PMQ, PVMQ), and the like.

Safety Valve Installation

The installation of safety valve (A) is carried out with specially designed tools. The safety valve is installed using installation tools placed in a lubricator (B) that allows seating the safety valve of the present invention (A) in the BPV (back pressure valve) housing of the pipe hanger (C).

The BPV housing has a special thread. It sits on said thread with the lubricator (B), and rotates until the valve seal is powered.

Once the multipad well installation works in the well to be operated are finished, the safety valve is removed from the well again using special tools.

The invention claimed is:

1. A safety valve, comprising an external casing (1) that has a hollow main body, an upper end (2) and a lower end (3), said main body of said external casing (1) configured to receive a piston (12) with a piston end (4) that slides axially between an upper position and a lower position, on the upper end (2) of said external casing (1) arranging an upper connection element (5), while at the lower end (3) of said external casing (1) there is a closing element (6) pivotally attached to an annular seat (7) and actuated by a second actuator (14), said piston end (4) comprising, in the lower portion thereof, a shoulder (8) that together with the main body inner wall of the hollow external casing (1) and the upper connection element (5) define an annular space configured to house a first actuator (9), characterized in that said closing element (6) provides a support face (17) on the annular seat (7), said support face (17) having a central surface (18) that projects in the axial direction and a recessed perimeter surface (19), wherein the central surface (18) and the recessed perimeter surface (19) join without interruption through a sloping intermediate surface (20), the recessed perimeter surface (19) and sloping intermediate surface (20) jointly form a first seal region, and said annular seat (7) has a second seal region consistent with said first seal region on the closing element (6), both regions thus defining a metal-metal seal (15), and wherein on an outer perimeter edge (21) of the second seal region of the annular seat (7), there is a perimeter groove (16) configured to house a seal element (13).

2. The safety valve according to claim 1, characterized in that said upper connection element (5) has an interface for the installation and removal of the safety valve.

3. The safety valve according to claim 1, characterized in that said closing element (6) is a clapper joined to said annular seat (7) by means of a hinged joint.

4. The safety valve according to claim 1, characterized in that a ledge (10) forms a lower stop for the stroke of said piston end (4).

5. The safety valve according to claim 1, characterized in that a ledge (10) defines a calibrated passage (11) for the stroke of piston (12).

6. The safety valve according to claim 1, characterized in that said second actuator (14) is a torsion spring.

7. The safety valve according to claim 6, characterized in that said hinged joint has a rotation axis where said torsion spring (14) is inserted.

8. The safety valve according to claim 1, characterized in that said central surface (18) and said sloping intermediate surface (20) define a frustoconical cross-section.

9. The safety valve according to claim 1, characterized in that said seal element (13) is of elastomeric type.

10. The safety valve according to claim 9, characterized in that said seal element (13) is composed of highly abrasion-resistant elastomers, such as nitrile butaidene rubber (NBR), ethylene propylene diene elastomer (EPDM), hexafluoropropylene thermopolymer, with vinylidene fluoride, tetrafluoroethylene and perfluoromethyl vinyl ether (FPM), elastomeric polyurethane, elastomeric silicone (VMQ, PMQ, PVMQ).

* * * * *